United States Patent [19]

Petroff

[11] Patent Number: 4,825,544

[45] Date of Patent: May 2, 1989

[54] SCISSORS SHARPENER

[75] Inventor: Cvetan Petroff, Kew, Australia

[73] Assignee: McPherson's Limited, Australia

[21] Appl. No.: 174,603

[22] Filed: Mar. 29, 1988

[30] Foreign Application Priority Data

Apr. 6, 1987 [AU] Australia ..... PI1271

[51] Int. Cl.[4] ..... B26B 13/22; B24B 3/52

[52] U.S. Cl. ..... 30/138; 76/82.2; 51/214; 51/285

[58] Field of Search ..... 30/138; 76/82, 86, 82.2, 76/104 A; 51/214, 204, 281 R, 285

[56] References Cited

U.S. PATENT DOCUMENTS 4,348,809 9/1982 Jackson ..... 51/214

*Primary Examiner*—Roscoe V. Parker

*Attorney, Agent, or Firm*—Lerner, David, Littenberg, Krumholz & Mentlik

[57] ABSTRACT

A scissors sharpener including a pair of elongate sharpening elements relatively arranged so as to define a vee shaped sharpening recess between them. Each sharpening element forms a respective one of two sides of the recess and each side has a longitudinal extent which is no less than the length of the scissor cutting edges to be sharpened. At least one of the sharpening elements is mounted so as to be movable laterally away from the other element, and resilient means bears against the movable element so as to resist the aforementioned movement. The sharpening elements overlie a base plate and an extension of that plate forms a platform against which the handle portion of scissors can rest during the sharpening operation. In use, scissors are located on the sharpener with the closed blades over the recess and the cutting edges extending generally in the longitudinal direction of the recess sides. Sharpening is effected by moving the closed blades sidwards through the recess towards the underlying base plate so that each cutting edge engages and is treated by a respective sharpening element during that movement.

29 Claims, 5 Drawing Sheets

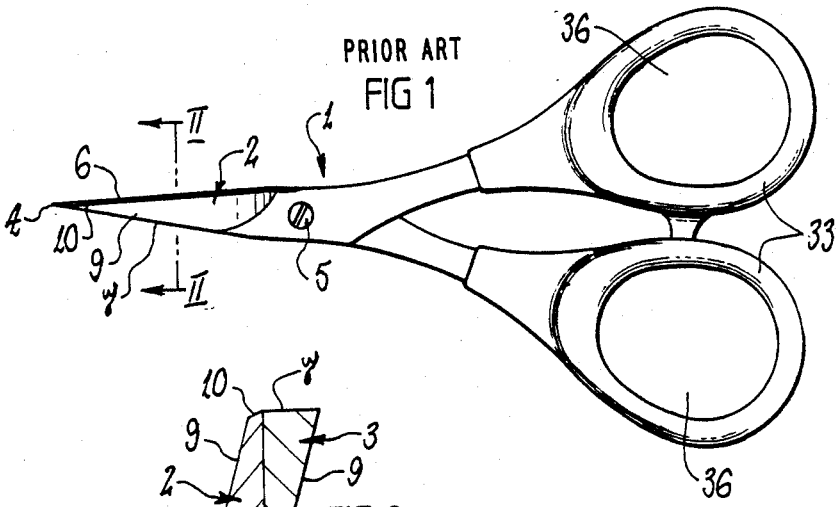
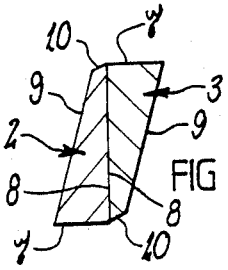
FIG 2 PRIOR ART
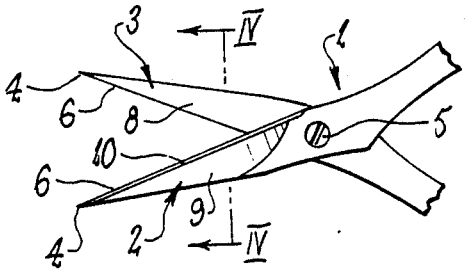
FIG 3 PRIOR ART
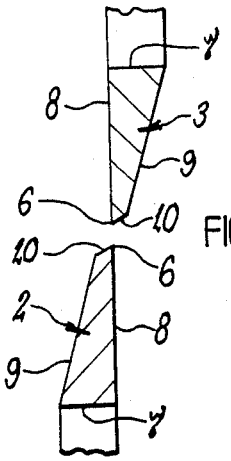
FIG 4 PRIOR ART

SCISSORS SHARPENER

BACKGROUND OF THE INVENTION

This invention relates to devices for sharpening scissors and is particularly concerned with such devices which are able to sharpen both scissor blades in a single operation. It is to be understood that the term "scissors" is used as a general term for pivoted blade cutting instruments and consequently the invention extends to devices for sharpening shears, for example.

Scissor sharpeners of the foregoing kind are generally arranged so that the sharpening action occurs in the longitudinal direction of the scissor blades, and one such device forms the subject of U.S. Pat. No. 4,348,809. The sharpening action produces minute grooves or striations in the longitudinal edge surfaces of the blades over which the sharpening elements move, and those striations extend in the longitudinal direction of the respective blade. Such longitudinal striations can adversely affect the operation of the scissors in some circumstances because they promote relative slippage between the scissor blades and an article or object engaged between those blades.

Whenever an article or object is being cut by scissors, a component of the forces generated by that cutting action will tend to push the article or object towards the tip end of the blades. Longitudinal striations as referred to above facilitate such relative movement or slippage and can therefore make it difficult to cut some objects, and particularly relatively thick objects. Manicure scissors, for example, can be difficult to use if the longitudinal working edges of the blades have longitudinally extending striations.

It is an object of the present invention to provide a scissors sharpener which is operative to simultaneously sharpen both blades and which does not produce longitudinal striations in the course of the sharpening operation. It is another object of the invention to provide such a sharpener which forms part of a scabbard or storage container for scissors.

A sharpener according to the invention is designed for use with scissors of the general kind described in U.S. Pat. No. 4,279,076. Such scissors have two blades arranged so that in the closed condition the cutting edge of each blade is either substantially coincident with the back edge of the other blade, or is located beyond that back edge. That is, each cutting edge forms a respective longitudinal boundary of the closed blade assembly, and it is that feature which enables convenient simultaneous sharpening of the two blades.

SUMMARY OF THE INVENTION

It is a characteristic of the sharpener of the present invention that a sharpening recess is defined between two sharpening elements, and that each of those elements is adapted to act upon a respective one of the two cutting edges of a pair of scissor blades which are moved laterally through that recess. That is, the scissor blades are moved in a direction transverse to the longitudinal direction of the blade cutting edges. The blades of the scissors are in a closed condition for the purpose of that operation, and the recess preferably has a shape which is substantially complementary to the peripheral shape of the assembly formed by the two blades. At least it is preferred that each side of the recess is substantially complementary to a respective one of the blade cutting edges in that it has substantially the same longitudinal shape and extends for the full length of that edge.

The longitudinal shape of a cutting edge is to be understood as the contour of that edge relative to an imaginary centreline of the blade assembly which passes through the axis of the blade pivot and the tip of the blades. That contour may be a straight line, or a curved line, or a combination of straight and curved lines. Furthermore, the contour may be different for each cutting edge of a particular blade assembly.

The invention, in a preferred form, is further characterised in that the sharpening elements are arranged so as to treat each cutting edge of the scissors in a progressive fashion. That is, the sharpening effect is progressively moved along the length of each cutting edge as the sharpening operation takes place.

In accordance with one aspect of the present invention, there is provided a scissors sharpener including, a support, two sharpening elements connected to said support, a sharpening recess defined between said elements so that each said element forms a respective one of two sides of said recess, each said side having a longitudinal extent which is not substantially less than the longitudinal extent of a respective one of the two cutting edges of a pair of interconnected scissor blades, and said elements are arranged so as to be operative to simultaneously sharpen the two cutting edges of a pair of closed scissor blades as a consequence of each said cutting edge contacting a respective said element as said closed scissor blades are moved sidewards through said recess with said cutting edges extending generally in the longitudinal direction of said sides.

In accordance with another aspect of the invention, there is provided a scissors sharpener including, a base member, two elongate sharpening elements connected to and extending across said base member, a sharpening recess defined between said elements so that each said element forms a respective one of two sides of said recess, said recess sides defining between them a shape which is substantially complementary to the shape defined between the two cutting edges of a pair of closed scissor blades, each said recess side having a longitudinal extent which is not substantially less than the longitudinal extent of a respective one of said cutting edges, a supporting platform located outwards from said elements so as to be engageable by scissor handles, and said elements are arranged so as to be operative to simultaneously sharpen the two cutting edges of a pair of closed scissor blades as a consequence of each said cutting edge contacting a respective said element as said scissor blades are moved sidewards through said recess from a front side thereof towards said underlying base member while the handles of said scissors are in engagement with said platform and said cutting edges are extending generally in the longitudinal direction of said sides.

In accordance with a further aspect of the invention, there is provided a method of sharpening scissors of the kind having the cutting edge of each blade arranged substantially coincident with the back edge of the other blade when the blades are in the closed condition, said method involving the steps of, closing said blades, locating said blades over a vee shaped recess defined between two elongate sharpening elements so that said cutting edges extend generally in the longitudinal direction of those elements, and moving said closed blades sidewards through said recess so that substantially the full length of each said cutting edge engages against a respective one of said elements during that movement.

BRIEF DESCRIPTION OF THE DRAWINGS

An embodiment of the invention is described in detail in the following passages of the specificaton which refer to the accompanying drawings. The drawings, however, are merely illustrative of how the invention might be put into effect, so that the specific form and arrangement of the various features as shown is not to be understood as limiting on the invention.

In the drawings:

FIG. 1 shows scissors of a kind which are usable with a sharpener according to the invention, FIG. 2 is an enlarged cross-sectional view taken along line II—II of FIG. 1, FIG. 3 shows the blades of the scissors of FIG. 1 in the open condition, FIG. 4 enlarged cross-sectional view taken along line IV—IV of FIG. 3, FIG. 5 a view of a sharpener according to one embodiment of the invention.

DESCRIPTION OF A PREFERRED EMBODIMENT

Figure 5:
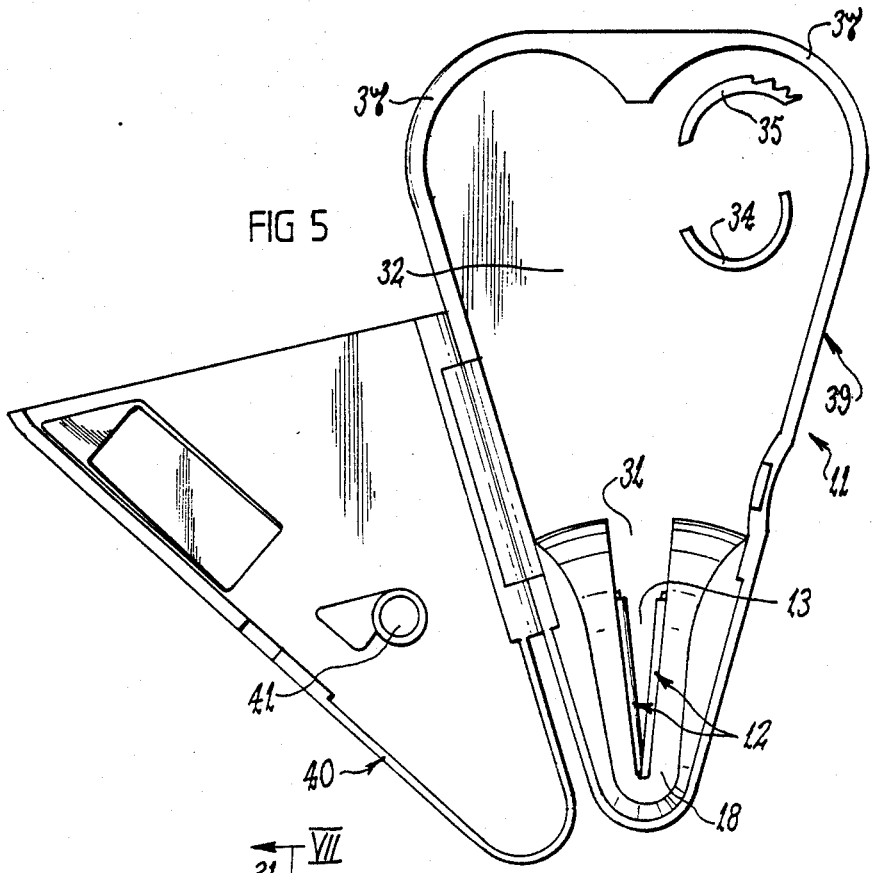
Figure 6:
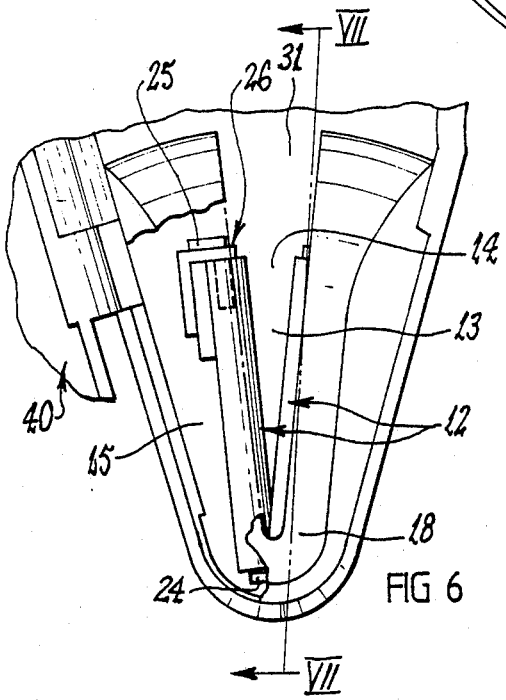
FIG. 6 shows part only of the sharpener of FIG. 5 with parts broken away for convenience of illustration.

It will be convenient to hereinafter describe the invention with particular reference to manicure scissors 1 of the kind as shown in FIGS. 1 to 4 having relatively narrow blades 2 and 3 which terminate in a fine point 4 at the tip of the blades 2 and 3 and are interconnected through a pivot 5. The cutting edges 6 usually have substantially the same contour, which is either a straight line or one having a slight curvature between its ends, and the back edge 7 of each blade 2 and 3 has the same contour.

Each blade 2 and 3 of such scissors 1 is commonly of plate-like form having an inner face 8 which is adjacent the corresponding face 8 of the other blade, and an outer face 9 which is remote from the other blade. The two inner faces 8 are in overlying opposed relationship when the blades 2 and 3 are closed. Each cutting edge 6 is formed at the junction of the respective inner face and a narrow longitudinal edge surface 10 which extends between the inner and outer faces 8 and 9. That edge surface 10 slopes at a slight angle outwardly from the inner face 8 towards the back edge 7 of the respective blade 2 or 3 as shown in FIGS. 2 and 4. Also, as shown in FIG. 2, each cutting edge 6 is substantially coterminus with the back edge 7 of the other blade when the blades 2 and 3 are in a closed condition as shown by FIG. 1.

An example embodiment of the invention which is adapted for use with scissors 1 as described above, will now be described. It is to be understood, however, that the invention can take other forms, especially if the sharpener is intended for use with scissors having blades different to those described above.

Figure 8:
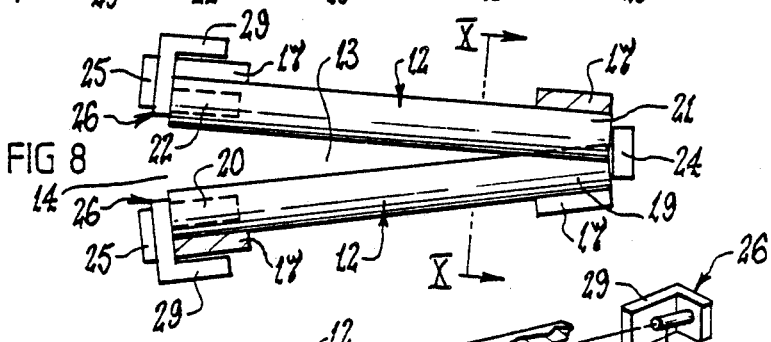
FIG. 8 is a cross-sectional view taken along line VIII—VIII of FIG. 7.

The example sharpener 11 shown in FIG. 5 includes a Pair of sharpening elements 12 arranged in partially overlapping relationship as best seen in FIG. 8 so as to define a sharpening recess 13 between them. The recess 13 is in the form of a narrow and deep vee having a shape substantially complementary to the shape defined between the cutting edges 6 of the blades 2 and 3, when closed, of the scissors 1 to be used with the sharpener 11. Each element 12 forms a respective one of the sides of the recess 13, and the longitudinal extent of each such side is preferably no less than the longitudinal extent of a respective one of the cutting edges 6. The recess 13 has an open mouth 14 at the end remote from the overlap of the two elements 12, and an open top or front to allow access of scissor blades as hereinafter described.

Any suitable material can be used to form the sharpening elements 12, but a hard ceramic material is usually preferred.

Each sharpening element 12 is mounted on a suitable support, which is a simple base plate 15 in the construction shown, in such a way as to permit the closed scissor blades 2 and 3 to be moved laterally through the sharpening recess 13 from the front thereof towards the base plate 15. That is, there needs to be sufficient space between the sharpening elements 12 and the base plate 15 to enable the sharpening operation to take place. In the arrangement shown, there is a space below the elements 12 which forms a cavity or pocket 16 (FIG. 7) to receive the blades 2 and 3 upon completion of the sharpening operation.

It is preferred that at least one of the sharpening elements 12 is mounted on the base plate 15 in a manner such as to permit movement relative to the other sharpening element 12. In particular, it is desirable to arrange the sharpening elements 12 so that the sharpening recess 13 can be enlarged laterally against a resilient resistance. Such an arrangement facilitates the sharpening operation by causing the sharpening elements 12 to apply pressure to the cutting edges 6 of the scissor blades 2 and 3 as they are moved through the sharpening recess 13. In an alternative arrangement, which is not shown, the same effect can be achieved by applying an endwise defeatable force to the scissors 1 during the sharpening operation. That is, the scissors 1 are able to move longitudinally away from the overlapping ends of the elements 12 against a resilient stop or barrier.

Figure 9:
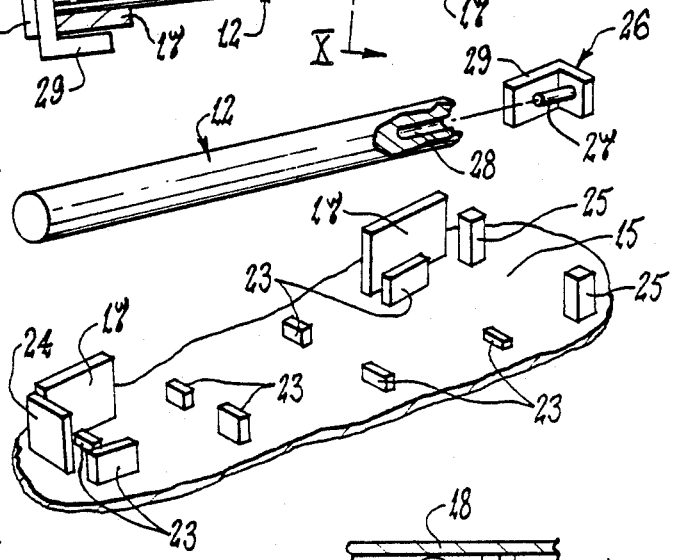
FIG. 9 is a exploded perspective view of part only of the sharpener of FIG. 5, FIG. 10 enlarged cross-sectional view taken along line X—X of FIG. 8.

In the arrangement shown, the mounting means for each of the sharpening elements 12 includes a pair of resilient deflector plates 17 as best seen in FIGS. 8 and 9. Each of those plates 17 either upstands from the base plate 15 or is connected to a cover member 18, and is located at a respective opposite end portion of the respective sharpening element 12. In the particular construction shown, one pair of deflector plates 17 is formed integral with the base plate 15 as shown in FIG. 9, and the other pair is formed integral with the cover member 18. Other arrangements are clearly possible.

Figure 10:
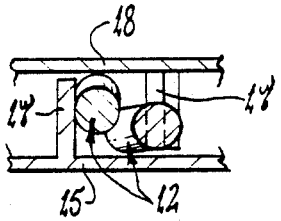
Figure 12:
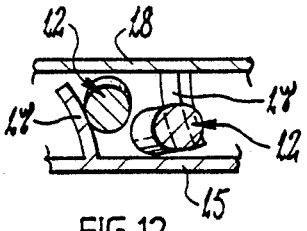
FIG. 12 is an enlarged cross-sectional view taken along line XII—XII of FIG. 11.
Figure 11:
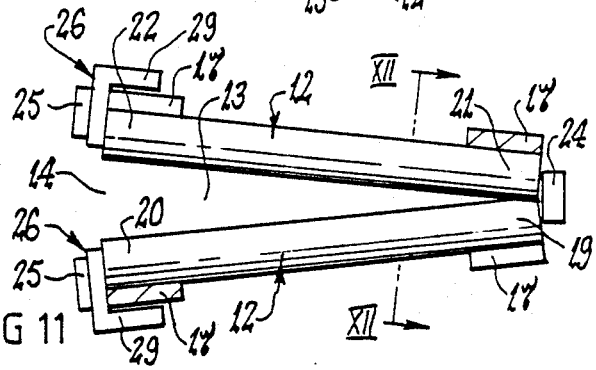
FIG. 11 is a view similar to FIG. 8 but showing the sharpening laterally relative to one another.

Each deflector plate 17 has a thickness such as to be capable of deflection or bending relative to the base plate 15 or cover member 18 as shown in FIG. 12. The sharpening elements 12 are located between the four deflector plates 17 so that each reacts against a respective two of those plates 17 and causes the plates 17 to deflect outwardly as the sharpening recess 13 is enlarged by forced entry of the closed scissor blades 2 and 3. FIGS. 8 and 10 show the plates 17 undeflected and the elements 12 held in their normal rest position. FIGS. 11 and 12 show the recess 13 enlarged (widened) and the plates 17 bent or deflected to accommodate that enlargement.

In the particular embodiment shown, each sharpening element 12 is in the form of a cylindrical member having a substantial length relative to its diameter. That is a convenient form for reasons hereinafter explained, but is not the only possible form. Each element 12 is a straight cylinder so that the sharpening recess 13 defined between them is in the form of a straight sided vee. As previously described, however, the cutting edge 6 of the scissor blades 2 and 3 to be sharpened may be slightly curved in the longitudinal direction and therefore has a longitudinal shape different to that of the sides of the sharpening recess 13. That difference, however, is not substantial and does not disturb the effectiveness of the sharpening operation.

Figure 7:
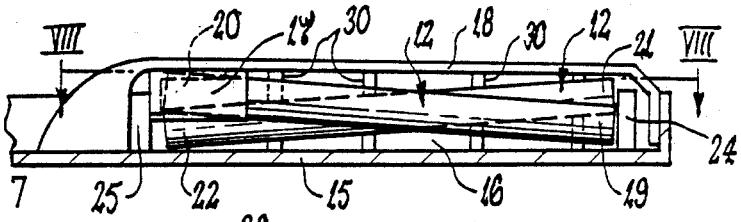
FIG. 7 is an enlarged cross-sectional view taken along line VII—VII of FIG. 6.

The two sharpening elements 12 are arranged angularly relative to one another so as to define the sharpening recess 13 between them and they preferably overlap at one end as best seen in FIG. 8. It is further preferred that each element 12 slopes relative to the general plane of the underlying base plate 15, as is best seen in FIG. 7. The extent of that slope need not be great—e.g., in the region of 5°—and, as shown, is preferably opposite in direction for each of the sharpening elements 12. That is, one of the elements 12 slopes upwardly from one end, whereas the other slopes downwardly from the corresponding end.

In the preferred arrangement as shown, one of the elements 12 slopes upwardly from the end 19 adjacent the base or tip of the sharpening recess 13 so that the end 20 of that element remote from the base or tip has a higher elevation relative to the base plate 15. The other element 12 has its base or tip end 21 at least partially overlying the adjacent end 19 of the first mentioned element 12 and is arranged to slope downwardly from that end 21 so that its other end 22 is located lower than the adjacent end of the first mentioned element 12. In the example shown, the base or tip end of each element 12 has substantially the same elevation relative to the base plate 15 as does the remote end of the other element 12.

Any suitable means may be provided to support each sharpening element 12 in the disposition described above. In the example shown, each element 12 rests upon each of a plurality of pillars 23 which upstand from the base plate 15 and are spaced apart in the longitudinal direction of the respective element 12. A respective group of those pillars 23 is provided for each element 12 as is shown in FIG. 9. Suitable end stops 24 and 25 may be provided to prevent longitudinal movement of each element 12, and retainer means may be provided to hold each element 12 against or adjacent its respective deflector plates 17.

In the arrangement shown, the retainer means for each sharpening element 12 includes a small bracket 26 having an axle section 27 which rotatably locates within an end bore 28 (FIG. 9) of the respective element 12, and a plate section 29 which locates around the deflector plate 17 at the end 20 or 22 of the element 12. The arrangement is such that the plate section 29 and the sharpening element 12 are on respective opposite sides of the deflector plate 17. The retainer means for each sharpening element 12 may also include a lug which engages against the inner side surface of the respective element 12 at the end 19 or 21. That inner side surface is the surface which defines a boundary of the sharpening recess 13. In the particular construction shown, the deflector plates 17 adjacent the element ends 19 and 21 serve as the retainer lugs.

Also in the particular arrangement shown, the retainer means includes a hollow cover member 18 which overlies and is connected to the base plate 15 and partially encloses the sharpening elements 12. That cover member 18 has two of the deflector plates 17 formed thereon or attached thereto, and it is also arranged to prevent movement of the sharpening elements 12 in an upward direction away from the base plate 15. For that purpose, the cover member 18 has two groups of a plurality of downwardly extending projections 30 (FIG. 7), each of which overlies a respective one of the sharpening elements 12 so as to be engageable with that element 12.

An access opening 31 (FIG. 5) is formed in the cover member 18 so as to permit scissor blades 2 and 3 to be introduced into the sharpening recess 13. That opening 31 may have a peripheral shape similar to that of the sharpening recess 13, but is generally larger than the recess 13 so as not to impede introduction of the scissor blades 2 and 3 into the recess 13.

Figure 13:
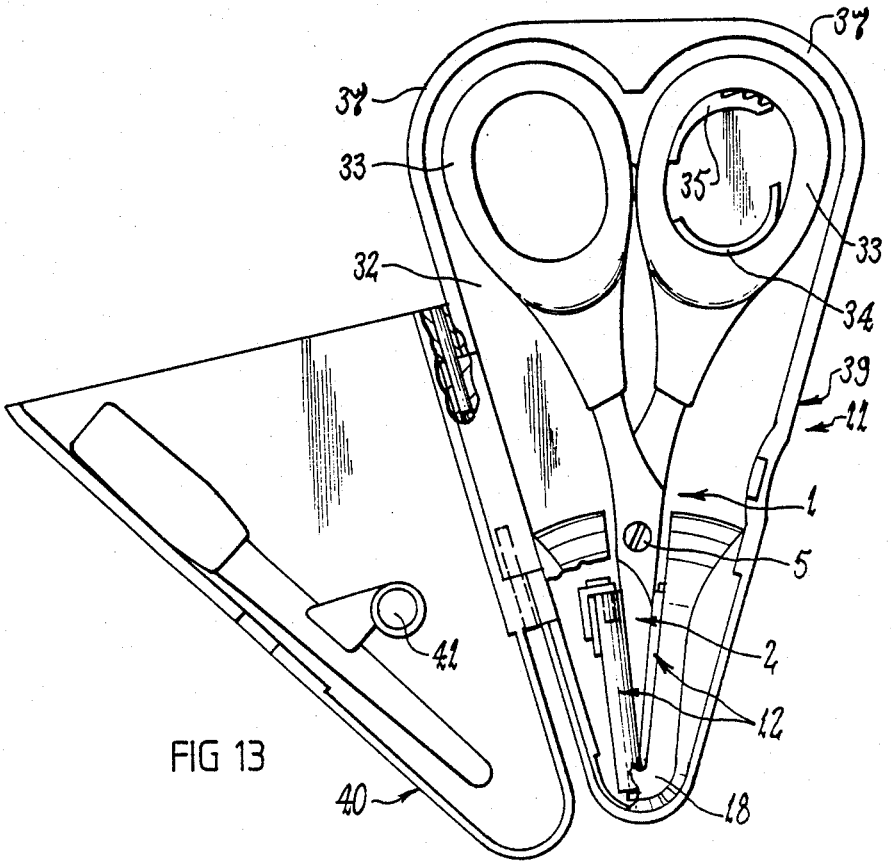
FIG. 13 is a view similar to FIG. 5 but showing scissors located within the sharpener.

It is preferred that the base plate 15 is extended beyond the open mouth 14 of the sharpening recess 13 so as to provide a supporting platform 32 for the handles 33 of the scissors 1. Locating means may be provided on that platform 32 to facilitate correct positioning of the scissors 1 relative to the sharpening elements 12. That locating means may include, as shown, two flanges 34 and 35 which upstand from the platform 32 and are arranged to locate within one of the finger openings 36 of the scissor handles 33. The locating means may also include a wall 37 which upstands from at least part of the periphery of the platform 32 and which locates around the outside of the scissor handles 32 as shown in FIG. 13.

Figure 14:
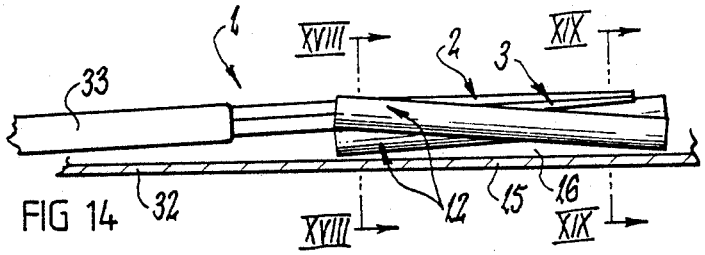
FIG. 14 is a semi-diagrammatic view of the sharpener with scissors located ready for commencement of a sharpening operation.

The arrangement is such that scissors 1 which are correctly positioned by the locating means 34, 35 and 37 have their blades 2 and 3 (closed) extending into the access opening 31 of the cover member 18 and resting on the underlying sharpening elements 12. In that condition, the scissors 1 slope upwardly from the handle end relative to the supporting platform 32 as shown in FIG. 14. Each scissor blade 2 and 3 engages a respective one of the sharpening elements 12 at a discrete zone only rather than along its full length. In the example shown, the tip end portion of the sharpening edge 6 of the blade 3 engages an elevated end portion of one sharpening element 12, and the opposite end portion of the sharpening edge 6 of the other blade 2 engages an elevated end portion of the other element 12.

Figure 15:
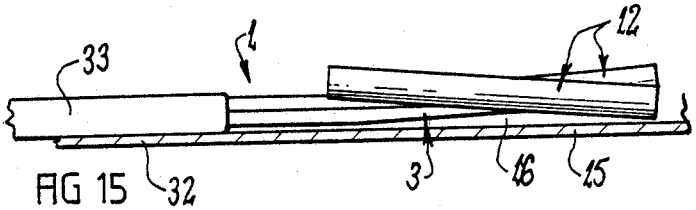
FIG. 15 is a view similar to FIG. 14 but showing the scissors positioned upon completion of the sharpening operation.

Sharpening is effected by applying a downward force on the scissors 1 so as to push the blades 2 and 3 laterally into and through the sharpening recess 13 towards the underlying base plate 15 to adopt the position shown in FIG. 15. The locating means 34, 35 and 37 coacts with the scissor handles 33 so as to prevent longitudinal movement of the blades 2 and 3 out of the recess 13 through the sharpening operation. The cylindrical surface of the sharpening elements 12 provides a camming or ramping facility such that the blades 2 and 3 can be forced into the sharpening recess 13, and the deflector plates 17 bend outwards to permit progressive lateral enlargement of that recess 13. In view of the resilient nature of the deflector plates 17, they maintain an inwardly directed bias on the sharpening elements 12 such that suitable pressure is maintained between those elements 12 and the engaging blade cutting edges 6. It will be appreciated, however, that other biasing means could be used for that purpose.

Figure 16:
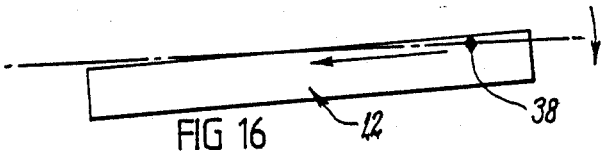
FIGS. 16 and 17 show, diagrammatically, movement of zone of contact between a sharpening element and the cutting edge of a scissor blade.
Figure 17:
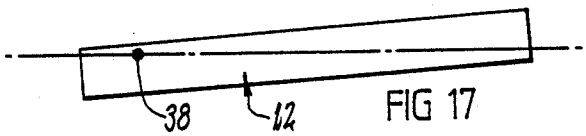

As the blades 2 and 3 are moved downwards through the sharpening recess 13, the zone of contact 38 (FIGS. 16 and 17) between each cutting edge 6 and the respective sharpening element 12 moves Progressively lengthwise of the recess 13. The direction of that movement will be opposite for each scissor blade 2 and 3, and FIGS. 16 and 17 show the movement occurring in connection with the blade 3. In any event, the relatively small zone of contact minimises the force necessary to move the sharpening elements 12 apart and thereby enable the blades 2 and 3 to pass through the recess 13, and the progressive shifting of that zone 38 ensures that the full length of each cutting edge 6 is sharpened.

The sharpening operation ceases when the blades 2 and 3 are moved below the sharpening elements 12 so as to be clear of engagement with those elements 12. The blades 2 and 3 are then contained in the pocket or cavity 16 such as to be protected while stored. Removal of the scissors 1 from that stored condition is effected by lifting the handles 33 away from the supporting platform 32 and then drawing the blades 2 and 3 lengthwise out of the storage pocket 16. That is, it is not necessary to return the blades 2 and 3 through the sharpening recess 13. If desired, the blades 2 and 3 can be returned to the storage pocket 16 in the reverse fashion so that sharpening does not take place.

Figure 18:
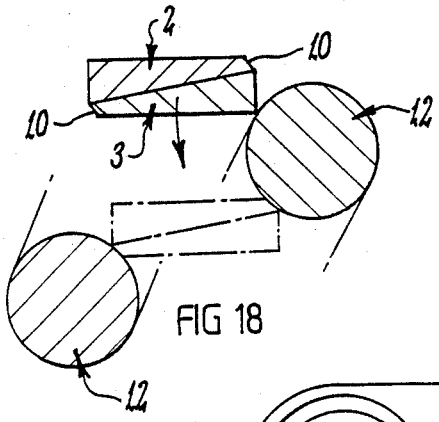
FIG. 18 is an enlarged cross-sectional view taken along line XVIII—XVIII of FIG. 14.
Figure 19:
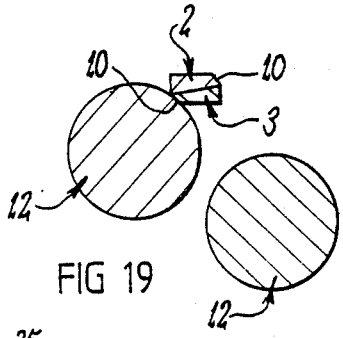
FIG. 19 is an enlarged cross sectional view taken along line XIX—XIX of FIG. 14.

It is a characteristic of the particular construction described that the scissor blades 2 and 3 are progressively shifted laterally, as shown in FIG. 18, away from one side of the sharpening recess 13 during the sharpening operation. The extent of that shift may be quite small and is governed by the angular disposition of the narrow longitudinal edge surface 10 of each blade. The sharpening action occurs across each of those surfaces 10 and consequently it is necessary for the blades 2 and 3 to follow an appropriate path during sharpening for that purpose.

The cylindrical nature of the sharpening elements 12 contributes to the aforementioned result. The narrow longitudinal edge surface 10 of one blade 2 or 3 is initially engaged with the cylindrical surface of a respective sharpening element 12 at a position above the axis of that element 12, whereas that engagement of the other blade occurs at or below the axis of the respective element 12. Thus, for the blade 2, the sharpening is effected across a curved surface in a direction towards the remote side of the sharpening recess 13, whereas for the other blade 3, the sharpening is effected across a curved surface in a direction away from the relevant remote side of the sharpening recess 13. The two directions are parallel and are at an angle other than a right angle relative to the general plane of the base plate 15.

It will be understood that the effect described above can be achieved with sharpening elements of non-cylindrical form.

Figure 20:
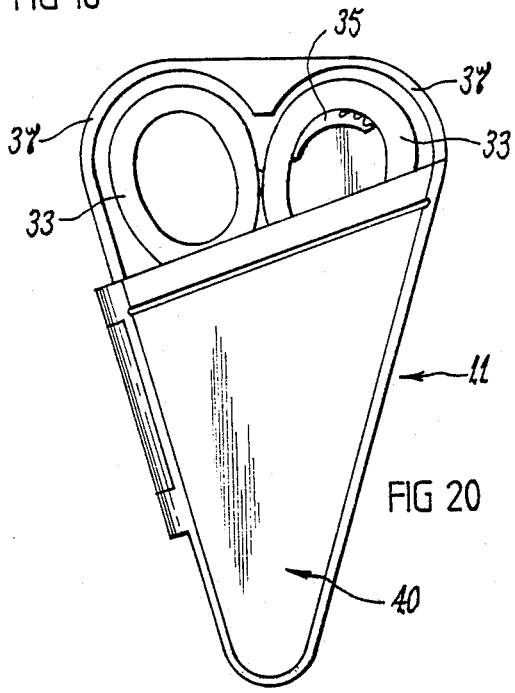
FIG. 20 shows the sharpener in a closed scissors containing condition.

According to the arrangement shown, the base plate 15 and the support platform 32 form a receptacle part 39 of a container for the scissors 1. Another closure part 40 is hingedly connected to that receptacle part 39 for movement between open and closed positions as shown by FIGS. 13 and 20 respectively, and suitable means may be provided to releasably retain those two parts 39 and 40 in the closed condition. For example, a snap engaging clip could be employed for the latter purpose. The arrangement is such that removal of the scissors 1 is prevented when the container is closed.

Means may be provided for automatically moving the scissor blades 2 and 3 through the sharpening recess 13 as the container is closed. One such means may comprise a projection 41 on the inside of the cover part 40 which is engageable with the scissors 1, in the region of the blade pivot 5, for example, so as to push the blades 2 and 3 through the sharpening recess 13 during the latter stage of the closing movement of that cover part 40. Obviously other means could be adopted for the same purpose.

A facility to retain a nail file 42 (FIG. 13) may be provided within either part of the container.

It will be apparent from the foregoing description that a sharpener according to the invention provides a convenient and effective means for sharpening scissor blades in a transverse fashion. That is, sharpening is effected across rather than longitudinally of the blade cutting edges.

Relative terms such as "upward", "downward", "above" and "beneath" as used throughout this specification are used for convenience of description only and are not to be understood as suggesting that the sharpener must be used in a particular disposition.

Various alterations, modifications and/or additions may be introduced into the constructions and arrangements of parts previously described without departing from the spirit or ambit of the invention as defined by the appended claims.

HAVING NOW described my invention, what I claim as new and desire to secure by Letters Patent is:

1. A scissors sharpener including, a support, two sharpening elements connected to said support, a sharpening recess defined between said elements so that each said element forms a respective one of two sides of said recess, each said side having a longitudinal extent which is not substantially less than the longitudinal extent of a respective one of the two cutting edges of a pair of interconnected scissor blades, and said elements are arranged so as to be operative to simultaneously sharpen the two cutting edges of a pair of closed scissor blades as a consequence of each said cutting edge contacting a respective said element as said closed scissor blades are moved sidewards through said recess with said cutting edges extending generally in the longitudinal direction of said sides.

2. A sharpener according to claim 1, wherein said elements are arranged relative to one another in a manner such that said recess has a shape which is substantially complementary to the shape defined between the cutting edges of a pair of closed scissor blades.

3. A sharpener according to claim 1, including resilient means which is operative to maintain pressure between said cutting edges and said elements during movement of the scissor blades through said recess.

4. A sharpener according to claim 3, wherein at least one of said elements is mounted so as to be movable laterally relative to the other said element, and said resilient means acts on said movable element to resist movement of that element away from the other said element.

5. A sharpener according to claim 4, wherein said resilient means includes at least one deflector plate which engages a side of the movable element and which resiliently deflects to permit movement of that element in one direction away from a normal rest position.

6. A sharpener according to claim 3, wherein said resilient means acts on each said element.

7. A sharpener according to claim 1, wherein said recess has an open mouth at one end of said sides thereof and an open front which extends from said one end towards the opposite end of said sides, said open mouth and said open front permitting movement of closed scissor blades into and through said recess from the front to the back thereof.

8. A sharpener according to claim 7, wherein part of said support is located behind said recess and a blade receiving space is provided between said elements and said support part, the arrangement being such that said closed blades can be moved longitudinally out of and into said space without passing through said recess.

9. A sharpener according to claim 1, including locating means which is operative to locate scissors so that the blades thereof are correctly positioned relative to said elements for movement through said recess to effect said sharpening.

10. A sharpener according to claim 9, wherein said support includes a supporting platform, said locating means is provided on said platform, and the handles of scissors bear against said platform as the blades of those scissors are moved through the sharpening recess.

11. A sharpener according to claim 10, wherein said locating means coacts with said scissors so as to prevent longitudinal movement of the scissor blades out of said recess during the sharpening operation.

12. A sharpener according to claim 10, wherein said supporting platform is arranged to support said scissors relative to said elements so that each said cutting edge is sharpened progressively along its length from one end towards the other, as said blades are moved through said recess.

13. A sharpener according to claim 12, wherein said elements are relatively arranged so as to be operative to cause the zone of sharpening of one said cutting edge to be progressively shifted from one end of the cutting edge in a direction towards the other end thereof, and to cause the zone of sharpening of the other said cutting edge to be progressively shifted in a direction opposite to said one direction.

14. A sharpener according to claim 13, wherein said elements react with said scissor blades during a sharpening operation so as to cause those blades to shift laterally towards one said element and away from the other, said lateral shift being in a direction generally across said support.

15. A sharpener according to claim 1, wherein said support forms part of a container for scissors, a closure part is connected to that container part for movement between open and closed positions, and said closure part is operative to cause movement of scissor blades through said recess during movement into said closed position thereof.

16. A sharpener according to claim 1, wherein each said element is in the form of a cylindrical rod, said rods overlap at one end Portion and diverge away from that end portion to define said recess between them.

17. A sharpener according to claim 16, wherein said rods are mounted on a base plate which forms portion of said support, one said rod slopes outwards from said base plate in a direction away from one end of that rod, and the other said rod slopes outwards from said base plate in a direction towards said one end of said one rod.

18. A sharpener according to claim 16, wherein each said rod is mounted for rotation relative to said support.

19. A sharpener according to claim 16, wherein said rods are arranged to coact with scissor blades during a said sharpening operation so that the zone of engagement between one said rod and one said sharpening edge is located above the longitudinal axis of said one rod, and the zone of engagement between the other said rod and the other said sharpening edge is located below the longitudinal axis of that other rod.

20. A sharpener according to claim 19, wherein each said zone of engagement is at a portion only of the respective said rod at any one point in time and shifts longitudinally of the respective said rod as said blades are moved through said recess.

21. A sharpener according to claim 20, wherein said zone of engagement shifts laterally across the surface of one said rod during movement of said blades through said recess so as to be closer to the other said rod, and the zone of engagement of said other rod shifts laterally so as to be further from said one rod.

22. A sharpener according to claim 1, wherein said elements are connected to a base plate of said support, a hollow cover member overlies said elements so that they are retained between said cover member and said base plate, and an access opening is provided in said cover member to permit closed scissor blades to be moved into said recess to effect said sharpening.

23. A scissors sharpener including, a base member, two elongate sharpening elements connected to and extending across said base member, a sharpening recess defined between said elements so that each said element forms a respective one of two sides of said recess, said recess sides defining between them a shape which is substantially complementary to the shape defined between the two cutting edges of a pair of closed scissor blades, each said recess side having a longitudinal extent which is not substantially less than the longitudinal extent of a respective one of said cutting edges, a supporting platform located outwards from said elements so as to be engageable by scissor handles, and said elements are arranged so as to be operative to simultaneously sharpen the two cutting edges of a pair of closed scissor blades as a consequence of each said cutting edge contacting a respective said element as said scissor blades are moved sidewards through said recess from a front side thereof towards said underlying base member while the handles of said scissors are in engagement with said platform and said cutting edges are extending generally in the longitudinal direction of said sides.

24. A sharpener according to claim 23, wherein at least one said rod is mounted for movement laterally away from the other said rod, and resilient means is operative to resist that movement.

25. A sharpener according to claim 24, wherein said resilient means includes a deflector plate engaging against each of two opposite end portions of said rod.

26. A method of sharpening scissors of the kind having the cutting edge of each blade arranged substantially coincident with the back edge of the other blade when the blades are in the closed condition, said method involving the steps of, closing said blades, locating said blades over a vee shaped recess defined between two elongate sharpening elements so that said cutting edges extend generally in the longitudinal direction of those elements, and moving said closed blades sidewards through said recess so that substantially the full length of each said cutting edge engages against a respective one of said elements during that movement.

27. A method according to claim 26, wherein each said cutting edge is progressively engaged with the respective said element, and said engagement progresses from one end of the cutting edge towards the other end thereof.

28. A method according to claim 27, wherein the direction of progressive engagement is opposite for each of the two said cutting edges.

29. A method according to claim 26, wherein said blades are shifted laterally in one direction during their movement through said recess.

* * * * *